US005238192A

United States Patent [19]

McNair

[11] Patent Number: 5,238,192

[45] Date of Patent: Aug. 24, 1993

[54] FILTER FOR SOLENOID OPERATED FLUID METERING DEVICES

[75] Inventor: Wanda J. McNair, Virginia Beach, Va.

[73] Assignee: Siemens Automotive L.P., Auburn Hills, Mich.

[21] Appl. No.: 809,747

[22] Filed: Dec. 18, 1991

[51] Int. Cl.[5] ..... B05B 1/14

[52] U.S. Cl. ..... 239/575; 239/585.1; 239/DIG. 23

[58] Field of Search ..... 239/575, 585.1, DIG. 23; 210/499

[56] References Cited

U.S. PATENT DOCUMENTS

| | | | |
|---|---|---|---|
| 3,721,390 | 3/1973 | Jackson | 239/585.1 |
| 4,453,671 | 6/1984 | Hafner | 239/575 |
| 4,491,272 | 1/1985 | Bradley et al. | 239/5 |
| 4,527,737 | 7/1985 | Deckard | 239/585.1 |
| 4,648,559 | 3/1987 | Fuller | 239/585.1 |
| 4,798,329 | 1/1989 | Mesenich | 239/585.1 |
| 4,941,612 | 7/1990 | Li | 239/585.1 |
| 4,981,266 | 1/1991 | Aichele et al. | 239/585.1 |
| 5,088,650 | 2/1992 | Takagi et al. | 239/575 |
| 5,098,016 | 3/1992 | Okamoto et al. | 239/585.1 |

*Primary Examiner*—Andres Kashnikow
*Assistant Examiner*—Lesley D. Morris
*Attorney, Agent, or Firm*—George L. Boller; Russel C. Wells

[57] ABSTRACT

That portion of the body of a bottom-feed solenoid operated fuel injector which is placed in communication with pressurized liquid fuel when the injector is mounted in an injector-receiving socket of a fuel rail contains a circumferentially continuous stepped groove in a radially outer portion of which a frameless circular fine mesh filter screen is disposed to cover a radially inner portion and through-holes via which liquid fuel enters the fuel injector. In one embodiment, the margins of the screen are welded to shoulders of the groove against which they are disposed. In another, they are crimped into slots adjacent the groove. In still another, at least one shoulder has a taper so that the corresponding screen margin wedges onto the shoulder. In yet another, a retaining ring is used.

14 Claims, 2 Drawing Sheets

FILTER FOR SOLENOID OPERATED FLUID METERING DEVICES

FIELD OF THE INVENTION

This invention relates to solenoid operated fluid metering devices such as solenoid operated fuel injector valves for internal combustion engines, and in particular to the organization and arrangement of a filter on such a device for filtering certain particulate material from fluid entering the device.

BACKGROUND AND SUMMARY OF THE INVENTION

It is known to make filter screens for certain solenoid operated fluid metering devices from plastic mesh screen supported by an overmolded frame. Certain plastic materials are not universally capable of maintaining compliance with relevant filtering specifications when subjected to certain fuel blends, such as certain gasoline/alcohol (i.e., flex fuel) mixtures. In order to provide adequate support for a plastic mesh screen, an overmolded frame may have to be of such a size and/or shape that it limits the ability to miniaturize the package size of a filter-equipped fuel injector.

The inventor has further observed that a stainless steel mesh screen can possess sufficient rigidity to be self-supporting so that in accordance with principles of the invention it becomes possible to provide a solenoid operated fluid metering device with a frameless filter screen that attaches directly to the body of the device. The use of stainless steel for the mesh material will solve the problem of compatibility with flex fuels, and a frameless filter will be more compact than one which includes a peripheral frame for supporting the screen.

Further features, advantages, and benefits of the invention, along with those just mentioned, will be seen in the ensuing description and claims which should be considered in conjunction with the accompanying drawings. The drawings disclose a presently preferred embodiment of the invention according to the best mode presently contemplated for carrying out the invention.

DESCRIPTION OF THE PREFERRED EMBODIMENT

Figure 1:
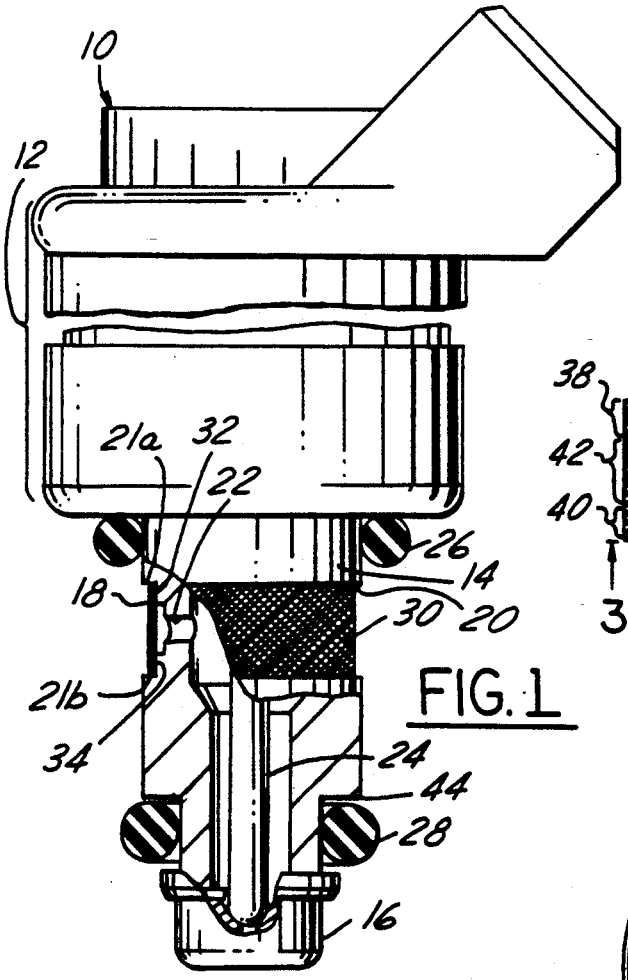
FIG. 1 is a longitudinal view, with portions broken away and in cross section, of a solenoid operated fuel injector embodying principles of the invention.

FIGS. 1–4 illustrate a fuel injector 10 embodying principles of the invention. The fuel injector is of the type commonly known as a bottom-feed type. It comprises a solenoid 12 at the top axial end of a generally tubular body 14. Body 14 comprises an outlet port 16 and an inlet port 18. Outlet port 16 is in the form of a nozzle at the axial end of body 14 opposite solenoid 12. Inlet port 18 is disposed in the sidewall of body 14 in axially spaced relation to outlet port 16. Inlet port 18 is bounded by a circumferentially continuous, circular, radially outwardly open groove 20 in body 14. Groove 20 is shown (in FIG. 1 only) stepped so as to comprise a radially outer portion that is defined by sides 21*a*, 21*b* and shoulders 32, 34 and a radially inner portion that is defined by sides (unnumbered) and a bottom (unnumbered). One or more circular through-holes 22 extend radially inwardly from the groove bottom to the interior of body 14.

The interior of body 14 contains a valve mechanism 24 that is operated by solenoid 12. Valve mechanism 24 is normally closed so that when solenoid 12 is de-energized, liquid fuel that is supplied to inlet port 18 does not flow through a flow path through the fuel injector to outlet port 16, and when solenoid 12 is energized, valve mechanism 24 opens to allow fuel flow with the result that fuel is injected at the nozzle.

In use, fuel injector 10 is typically assembled into a corresponding socket in a fuel rail (not shown). The socket transversely intersects a longitudinal fuel passage in the fuel rail. The fuel injector contains two axially spaced apart O-rings 26, 28 around its outside, and they serve to seal the fuel injector in the socket so that fuel will not leak from the axial region between them which is communicated to the pressurized liquid fuel that is within the longitudinal fuel passage of the fuel rail.

A circular cylindrical fine mesh filter screen 30 is assembled onto body 14. Filter screen 30 is disposed within the radially outer portion of groove 20 against shoulders 32, 34 so as to be in covering relation to the radially inner groove portion and hole(s) 22. Filter screen 30 is fabricated from a suitable length of screen material of a width corresponding to the axial dimension of the completed filter screen. The length of screen material is formed to a circular shape having lengthwise end margins overlapped and seam welded together to form a seam 36 that does not compromise the integrity of the screen's mesh because it does not allow fuel-entrained particulates greater than the screen's mesh to intrude through the seam.

For the embodiment of FIG. 1, the filter screen is fabricated by laying the screen material lengthwise into the radially outer portion of groove 20, tacking it to the shoulders 32, 34, wrapping it tightly around shoulders 32, 34, and then welding the overlapped lengthwise ends of the strip together to create seam 36. Alternately, the final step could consist of tacking the overlapped ends and then seaming them together To insure integrity of the assembly, cylindrical margins 38, 40 of the filter screen that axially bound a central filtering zone 42 of the filter screen and that are in direct and circumferentially continuous contact with shoulders 32, 34 of body 14 are welded directly to the body to create respective joints that are effective to preclude fuel-entrained particulates of a size that would be filtered by zone 42 from reaching the radially inner portion of the groove and hole(s) 22 by intruding between shoulders 32, 34 and margins 38, 40. Welding can be conducted by conventional procedures such as laser or resistance welding. It is preferable for the seam 36 to be located other than over a hole 22. The radially inner portion of groove 20 serves to distribute filtered fuel around the full circumference of the fuel injector and thereby avoid restricting the flow to the individual hole(s) 22.

Figure 5:
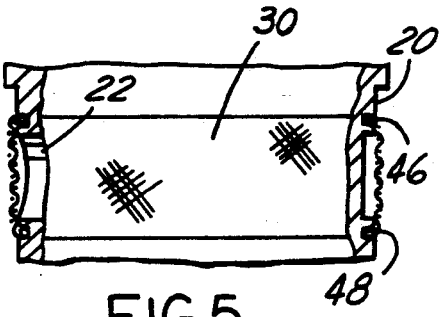
FIG. 5 is an enlarged fragmentary sectional view of a second embodiment.

FIG. 5 illustrates another embodiment in which the radially outer portion of groove 20 extends axially all the way to an axially facing shoulder designated by numeral 44 in FIG. 1 so that as a result side 21*b* is eliminated. In addition, body 14 comprises two narrow circumferentially continuous, circular, radially outwardly open slots 46, 48 that are disposed in shoulders 32, 34 to opposite axial sides of the radially inner portion of the groove. Thus after having been formed to circular shape and provided with seam 36, the screen is slid axially over the nozzle end of body 14 to a final position covering the radially inner portion of the groove and hole(s) 22. The edges of margins 38, 40 are mechanically crimped, or pressed, into slots 46, 48 to complete the assembly. The crimp joints prevent intrusion of particulate material between the screen margins and the outside of body 14, and do not necessarily require welding.

Figure 6:
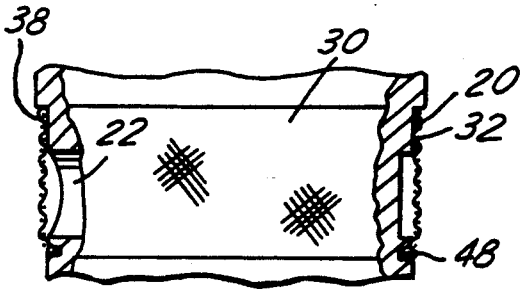
FIG. 6 is an enlarged fragmentary sectional view of a third embodiment.

FIG. 6 illustrates still another embodiment which embodies certain features of the previously described embodiments. As in the FIG. 5 embodiment, groove 20 is fully open to shoulder 44 to allow the filter screen which has already been formed to circular shape to be slid axially over the nozzle end of the fuel injector to place margin 38 over shoulder 32. A single slot 48 is provided for allowing the edge of the other margin 40 to be crimped into it. The margin 38 is joined to the injector body by welding.

Figure 7:
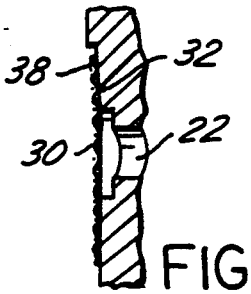
FIG. 7 is an enlarged fragmentary sectional view of a fourth embodiment.
Figure 2:
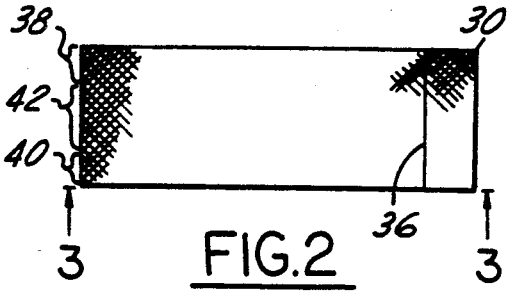
FIG. 2 is an enlarged side view of the filter screen of the fuel injector shown by itself.
Figure 3:
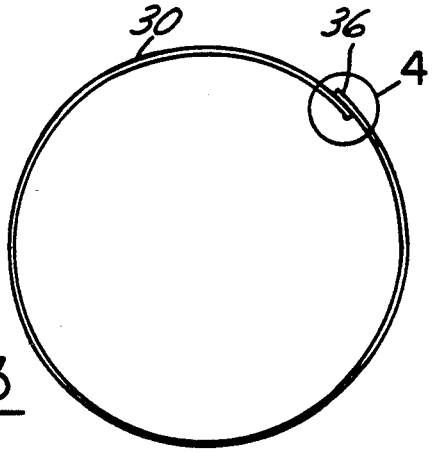
FIG. 3 is a view in the direction of arrows 3—3 in FIG. 2.
Figure 4:
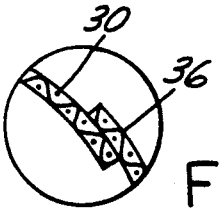
FIG. 4 is an enlarged view in circle 4 of FIG. 3.

While it may be deemed preferable to weld margin 38 to shoulder 32 as described in preceding embodiments, such a step may be optionally dispensed with by making shoulder 32 to have a slight taper as shown on a somewhat enlarged scale by the still further embodiment of FIG. 7. Such a tapered shoulder will exert a wedging action on the upper margin 38 as the circular screen is being axially slid to final position on body 14. This will serve to circumferentially tension the upper screen margin on the body and offers the possibility of a joint that will allow for the welding step to be dispensed with. The lower margin 40 is joined to body 14 by welding, but could alternatively be joined by crimping in the manner of FIGS. 5 or 6.

Figure 8:
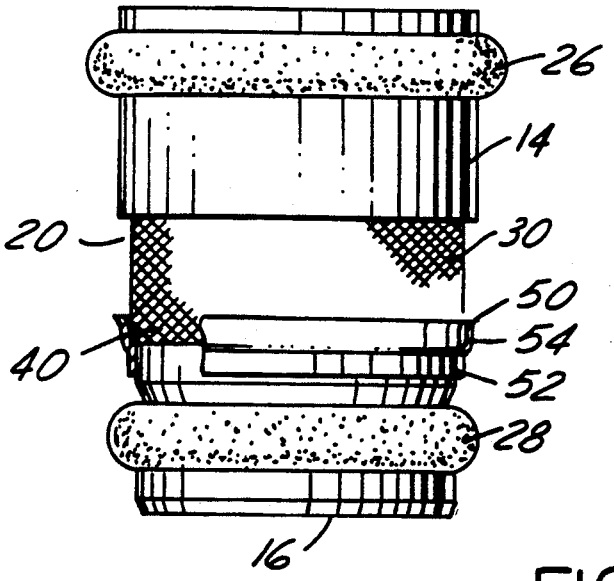
FIG. 8 is an enlarged fragmentary view of a fifth embodiment with a portion being broken away.

The embodiment of FIG. 8 is like that of FIG. 7 except insofar as the joining of margin 40 to body 14 is concerned. The assembly of the screen to the injector proceeds in the same manner as in the case of FIG. 7 until the step of securing the lower margin 40 to the body. Such securement is obtained, not by welding, but rather by sliding a retention ring 50 over the nozzle end of the body. Ring 50 has a circular body engaging portion 52 that is pressed onto body 14 and a circular filter engaging portion 54 that girdles the lower margin 40. Portion 54 is shaped to have a suitable lead for fitting over the lower margin 40 as ring 50 is brought to its final position of assembly as shown in FIG. 8. Portion 54 serves to retain the lower margin 40 against the underlying shoulder surface so that the integrity of the joint is assured. Thus ring 50 axially overlaps both the filter screen mesh margin and the valve body. It is to be understood that the steps of assembling filter screen 30 and ring 50 onto the fuel injector occur prior to the step of assembling O-ring 28, as would also be true for assembling the filter screens to the bodies in the embodiments of FIGS. 5, 6, and 7.

A preferred screen material for filter screen 30 is 304-L stainless steel woven wire having a single or multiple layers. A sintered Dutch weave, or equivalent, will provide appropriate filtration (44 microns or less) and rigidity. A two-layer screen may comprise a fine filtration cloth layer on the outside and a reinforcing cloth layer on the inside that are sintered together to produce a single laminate which is equivalent to the sintered Dutch weave. Thus, such a two-layer screen may be substituted for the sintered Dutch weave in any of the drawing FIGS., and it may also be used in any injector which does not have a step in the groove. In this latter case, the reinforcing cloth layer serves as a drainage cloth which performs a function equivalent to that of the stepped radially inner portion of groove 20 in the embodiments illustrated in the drawing FIGURES.

While a principal intent of this invention is to provide a filter that will be resistant to flex fuels, certain principles may be applied to non-stainless-steel (such as plastic) mesh screens that are used in non-flex fuel applications.

Although it is not expressly illustrated in the drawing, the embodiment of FIG. 1 could have both its shoulders 32, 34 tapered in the same manner as the single tapered shoulder 32 of FIG. 7. In such a case, the lower shoulder's 34 taper will be the mirror image of the upper shoulder's 32 about a transverse plane bisecting groove 20.

In all embodiments the entire circumferential area of filtering zone 42 is open to hole(s) 32 on account of the stepped nature of the groove, and the filter screen itself is radially recessed although for drawing convenience only FIG. 1 shows such a stepped groove.

While a presently preferred embodiment of the invention has been illustrated and described, it should be appreciated that principles of the invention are applicable to other embodiments.

What is claimed is:

1. A solenoid operated fluid metering device, namely a bottom-feed fuel injector, comprising a body which has a cylindrical sidewall containing an inlet port via which liquid fuel is introduced into the fuel injector, an outlet port at an adjacent axial end of said body, a fuel path through said body between said inlet and outlet ports, and an electrically operated mechanism that controls the flow of liquid fuel from said inlet port to said outlet port characterized by a fine mesh cylindrical filter screen disposed in circumferentially surrounding relation to said cylindrical sidewall and covering relation to one or more through-holes that extend from said inlet port into the interior of said body, said screen having at opposite axial ends cylindrical margins that axially bound a central filtering zone of the filter and that are in direct contact with said body around the circumference thereof so as to preclude fuel-entrained particulates of a size that would be filtered by said central filtering zone from reaching said one or more through-holes by intruding between said sidewall and said margins, and characterized further in that at least one of said margins comprises a cylindrical stainless steel mesh that is sealed to said sidewall by having been welded directly thereto.

2. A solenoid operated fluid metering device, namely a bottom-feed fuel injector, comprising a body which has a cylindrical sidewall containing an inlet port via which liquid fuel is introduced into the fuel injector, an outlet port at an adjacent axial end of said body, a fuel path through said body between said inlet and outlet ports, and an electrically operated mechanism that controls the flow of liquid fuel from said inlet port to said outlet port characterized by a fine mesh cylindrical filter screen disposed in circumferentially surrounding relation to said cylindrical sidewall and covering relation to one or more through-holes that extend from said inlet port into the interior of said body, said screen having at opposite axial ends cylindrical margins that axially bound a central filtering zone of the filter and that are in direct contact with said body around the circumference thereof so as to preclude fuel-entrained particulates of a size that would be filtered by said central filtering zone from reaching said one or more through-holes by intruding between said sidewall and said margins, and characterized further in that at least one of said margins comprises a cylindrical stainless steel mesh that is sealed to said sidewall by crimping thereof directly into a corresponding slot in said sidewall.

3. A solenoid operated fluid metering device, namely a bottom-feed fuel injector, comprising a body which has a cylindrical sidewall containing an inlet port via which liquid fuel is introduced into the fuel injector, an outlet port at an adjacent axial end of said body, a fuel path through said body between said inlet and outlet ports, and an electrically operated mechanism that controls the flow of liquid fuel from said inlet port to said outlet port characterized by a fine mesh cylindrical filter screen disposed in circumferentially surrounding relation to said cylindrical sidewall and covering relation to one or more through-holes that extend from said inlet port into the interior of said body, said screen having at opposite axial ends cylindrical margins that axially bound a central filtering zone of the filter and that are in direct contact with said body around the circumference thereof so as to preclude fuel-entrained particulates of a size that would be filtered by said central filtering zone from reaching said one or more through-holes by intruding between said sidewall and said margins, and characterized further in that one of said cylindrical margins of said screen comprises a cylindrical mesh and said sidewall comprises a taper onto which said cylindrical mesh of said one of said cylindrical margins is directly wedged.

4. A solenoid operated fluid metering device, namely a bottom-feed fuel injector, comprising a body which has a cylindrical sidewall containing an inlet port via which liquid fuel is introduced into the fuel injector, an outlet port at an adjacent axial end of said body, a fuel path through said body between said inlet and outlet ports, and an electrically operated mechanism that controls the flow of liquid fuel from said inlet port to said outlet port characterized by a fine mesh cylindrical filter screen disposed in circumferentially surrounding relation to said cylindrical sidwall and covering relation to one or more through-holes that extend from said inlet port into the interior of said body, said screen having at opposite axial ends cylindrical margins that axially bound a central filtering zone of the filter and that are in direct contact with said body around the circumference thereof so as to preclude fuel-entrained particulates of a size that would be filtered by said central filtering zone from reaching said one or more through-holes by intruding between said sidewall and said margins, and characterized further in that one of said cylindrical margins of said screen comprises a cylindrical mesh, a separate retaining ring is fitted onto said body and engages both said body and said cylindrical mesh of said one of said cylindrical margins of said screen, axially overlapping both said body and said cylindrical mesh of said one of said cylindrical margins of said screen on the outside thereof, to maintain said cylindrical mesh of said one of said cylindrical margins of said screen on the outside thereof, to maintain said cylindrical mesh of said one of said cylindrical margins of said screen in direct contact with said body.

5. A device as set forth in claim 4 characterized further in that said body comprises a radially outwardly open groove in which said filter screen is disposed.

6. A device as set forth in claim 5 characterized further in that said groove is a stepped groove having a radially outer portion and a radially inner portion, and said filter screen is disposed in said radially outer portion in filtering relation to said radially inner portion and said one or more through-holes.

7. A device as set forth in claim 4 characterized further in that said cylindrical mesh of said one of said cylindrical margins of said screen comprises stainless steel mesh.

8. A device as set forth in claim 1 characterized further in that said body comprises a radially outwardly open groove in which said filter screen is disposed.

9. A device as set forth in claim 8 characterized further in that said groove is a stepped groove having a radially outer portion and a radially inner portion, and said filter screen is disposed in said radially outer portion in filtering relation to said radially inner portion and said one or more through-holes.

10. A device as set forth in claim 2 characterized further in that said body comprises a radially outwardly open groove in which said filter screen is disposed.

11. A device as set forth in claim 10 characterized further in that said groove is a stepped groove having a radially outer portion and a radially inner portion, and said filter screen is disposed in said radially outer portion in filtering relation to said radially inner portion and said one or more through-holes.

12. A device as set forth in claim 3 characterized further in that said body comprises a radially outwardly open groove in which said filter screen is disposed.

13. A device as set forth in claim 12 characterized further in that said groove is a stepped groove having a radially outer portion and a radially inner portion, and said filter screen is disposed in said radially outer portion in filtering relation to said radially inner portion and said one or more through-holes.

14. A device as set forth in claim 3 characterized further in that said cylindrical mesh of said one of said cylindrical margins of said screen comprises stainless steel mesh.

* * * * *